US008522377B2

(12) United States Patent
Hart

(10) Patent No.: US 8,522,377 B2
(45) **Date of Patent: *Sep. 3, 2013**

(54) UNDER BED SKIRT SUPPORT WITH FULLY SEPARATED CORNERS AND WITH LAYERS THAT DO NOT HAVE TO BE EQUALLY LOFTED

(76) Inventor: Sherry Lynn Hart, Aurora, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/448,377

(22) Filed: Apr. 16, 2012

(65) Prior Publication Data

US 2012/0198617 A1 Aug. 9, 2012

Related U.S. Application Data

(63) Continuation-in-part of application No. 13/136,567, filed on Aug. 4, 2011, now Pat. No. 8,156,584, which is a continuation of application No. 11/816,276, filed as application No. PCT/US06/05679 on Feb. 15, 2003, now abandoned.

(60) Provisional application No. 60/653,343, filed on Feb. 15, 2005.

(51) Int. Cl.
*A47C 31/10* (2006.01)
*A47G 9/00* (2006.01)

(52) U.S. Cl.
USPC ..... 5/482; 5/493

(58) Field of Classification Search
USPC ..... 5/482, 493
See application file for complete search history.

(56) References Cited

U.S. PATENT DOCUMENTS

| | | | | |
|---|---|---|---|---|
| 5,205,003 | A * | 4/1993 | Green | 5/493 |
| 5,621,931 | A * | 4/1997 | Hamilton | 5/493 |
| 6,119,290 | A * | 9/2000 | Masoncup | 5/493 |
| 6,971,129 | B2 * | 12/2005 | Wootten et al. | 5/493 |
| 8,156,584 | B1 * | 4/2012 | Hart | 5/493 |
| 2007/0056099 | A1 * | 3/2007 | Langenberger | 5/493 |

* cited by examiner

*Primary Examiner* — Robert G Santos
*Assistant Examiner* — Myles Throop
(74) *Attorney, Agent, or Firm* — Gary P. Topolosky

(57) ABSTRACT

A bed skirt support (10) is disclosed comprising a relatively flat, central portion or decking (14) having at least on side support section (16, 18, 20) removably or fixedly attached thereto. Said bed skirt support has fully separated corners and multiple layers, each of which does not have to be lofted at the same gathering ratio as its adjacent layers.

20 Claims, 15 Drawing Sheets

UNDER BED SKIRT SUPPORT WITH FULLY SEPARATED CORNERS AND WITH LAYERS THAT DO NOT HAVE TO BE EQUALLY LOFTED

CROSS-REFERENCE TO RELATED APPLICATIONS

This application is a continuation-in-part of U.S. patent application Ser. No. 13/136,567, filed on Aug. 4, 2011, which is a continuation of U.S. patent application Ser. No. 11/816,276, filed on Aug. 14, 2007, which claimed the benefit of U.S. Provisional Application Ser. No. 60/653,343, filed on Feb. 15, 2005. It also relates to U.S. Design patent application Ser. No. 29/223,625, filed on Feb. 15, 2005 (the '625 application), which issued on Apr. 17, 2007 as U.S. Design Pat. No. D540,604. All of the aforementioned are incorporated by reference as though fully set forth herein.

BACKGROUND OF THE INVENTION a. Field of the Invention

The instant invention relates to decorative bedding. In particular, the instant invention relates to a bed skirt support for supporting a bed skirt or dust ruffle.

b. Background Art

It is well known to use bed skirts or dust ruffles to make a bedroom more aesthetically pleasing and functional. Typically, a bed skirt or dust ruffle is used to cover an otherwise exposed box spring or lower mattress of a bed. For example, a decorative bed skirt may be attached to the bed so as to hang over and hide the sides of the box spring from plain view. In the past, the lower edge of such a decorative bed skirt hangs vertically along the vertical sides of the box spring, and extends straight down towards the floor (see, for example, FIG. 19). If not carefully installed, these drooping bed skirts can end up extending onto the floor adjacent to the bed and may end up being soiled or damaged by vacuums or people stepping on the bed skirts when getting into or out of the bed, or while making the bed.

Thus, there remains a need for a better system for hiding box springs in an aesthetically pleasing and function manner.

BRIEF SUMMARY OF THE INVENTION

It remains desirable to have a system for hiding the box spring or lower mattress of a bed using a decorative bed skirt or dust ruffle. Preferably, the system allows someone to use an existing decorative bed skirt or dust ruffle, and the system facilitates the desired hiding of the box spring in a manner that mitigates potential damage to the typically expensive decorative bed skirt or dust ruffle. In a first form, the present invention comprises a bed skirt support that underlies and supports a bed skirt by lifting the bed skirt away from the vertical sides of the box spring, providing an aesthetically pleasing appearance while also lifting the lower longitudinal edges of the bed skirt off the floor, thereby mitigating potential damage to the decorative bed skirt by individuals moving around the perimeter of the bed. In one aspect, the bed skirt support preferably makes it possible to change the overall appearance of the bed skirt by physically changing how the bed skirt hangs relative to the vertical sides of the box spring.

In another embodiment of the invention, a bed skirt support comprises a flat central portion adapted to lie on a box spring of a bed, and one or more side support sections that extend from the flat central portion. In one configuration, for example, each side support section may comprise one or more gathers or ruffles that extend at an angle from the side edge of the box spring toward the floor. When a bed skirt is placed over the bed skirt support, the side support sections loft the bed skirt sides away from the side edges of the box spring.

In a further configuration, the side support sections of the bed skirt support may be removable from the decking or central portion of the bed skirt support, such as via a zipper, hook and loop fasteners, snaps, or the like. In this configuration, a plurality of side support sections may be provided to support a bed skirt at a different angle or to create a different appearance of the bed skirt hanging from the box spring. In this configuration, for example, a user may select one or more of the side support sections and attach it to the central portion of the bed skirt support to provide varying support surfaces for a decorative bed skirt.

In another embodiment of the invention, a bed skirt is provided with an integrated bed skirt support. In this embodiment, a side support section is provided on a lower or upper side of a skirt section of the decorative bed skirt. The side support section, for example, may support the skirt section of the decorative bed skirt from below or may support the skirt section from above. However, a typical decorative bed skirt may still be used in combination with this embodiment to provide a user with an unlimited number of design options.

In yet another embodiment of the invention, a decorative bed skirt may be provided in which a decorative skirt side section of the decorative bed skirt extends from one or more sides of a generally flat central portion. In this embodiment, the bed skirt section of the bed skirt support is decorative and can be used to decorate a bed without requiring the use of a separate decorative bed skirt. Again, a typical decorative bed skirt may be used in combination with this embodiment to provide a user with an unlimited number of design options.

The foregoing and other aspects, features, details, utilities, and advantages of the present invention will be apparent from reading the following description and claims, and from reviewing the accompanying drawings.

DETAILED DESCRIPTION OF THE INVENTION

Figure 1:
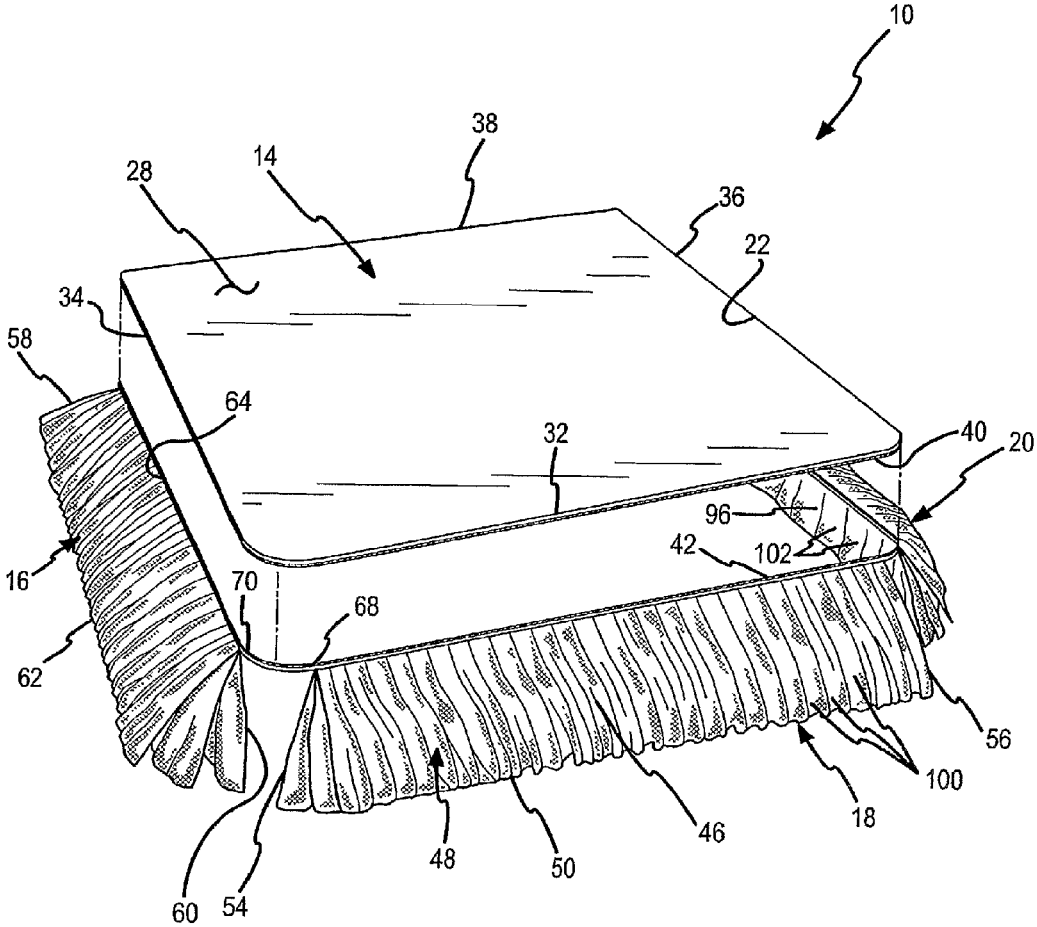
FIG. 1 is an exploded, isometric view of a bed skirt support according to a first embodiment of the present invention.

The present invention comprises a configurable bed skirt support 10 constructed to support a decorative bed skirt or decorative dust ruffle 12 (see FIGS. 18 and 19) in an aesthetically pleasing manner that also provides various functional benefits that will be described further below. FIG. 1 is an exploded, isometric view of a bed skirt support 10 according to a first embodiment of the present invention. As shown in this figure, the bed skirt support 10 comprises a deck or decking 14 that supports at least one bed skirt support section. In the particular embodiment depicted in FIG. 1, the decking supports three support sections, including a left side support section 16, a front support section 18, and a right side support section 20 around an outer perimeter of the decking These support sections 16, 18, 20, may be fixedly attached to the decking 14; or, as explained further below, these support sections may be removably or separably attached or connected to the decking by a connection means including, for example, one or more zippers, hooks, hook-and-loop material, snaps, tape, adhesives, pins, or any other type of anchors or fasteners.

In the embodiment depicted in FIG. 1, the decking 14 may be constructed from, for example, cotton, muslin, a polyester blend, or a variety of other materials. The decking is generally rectangular and sized to fit between a box spring 24 and a mattress 26 as shown to good advantage in, for example, FIG. 12. Since the decking 14 will generally be sandwiched between the top mattress 26 and the box spring 24 when the bed skirt support 10 is installed on a bed, the decking is designed such that its outer perimeter 22 will essentially match the outer perimeter of, for example, the box spring 24 on which it will be placed during use. The decking includes a top surface 28, an under side 30 (not visible in FIG. 1, but visible in, for example, FIGS. 3, 4B, 4C, and 7), a front edge 32, a left edge 34, a right edge 36, and a rear edge 38. In the particular embodiment depicted in FIG. 1, the inner one-half 40 of a U-shaped zipper (which may be, for example, a molded zipper or a coil zipper) is attached along the left edge 34, the front edge 32, and the right edge 36 of the decking 14. The outer one-half 42 of the zipper is connected to the support sections 16, 18, 20 so that they can be draped from the decking 14 when it is sandwiched between the top mattress 26 and the box spring 24. As explained further below, the U-shaped zipper makes it possible in this embodiment to completely separate the support sections from the decking The U-shaped zipper depicted in FIG. 1, could be replaced by, for example, three straight zippers, one for the left side support section 16, one for the front support section 18, and one for the right side support section 20.

As mentioned above and as shown in FIG. 1, the bed skirt support 10 according to the first embodiment has three support sections 16, 18, 20 including the left side support section 16, the front support section 18, and the right side support section 20. In alternative configurations, one or more of these support sections could be left out, depending upon, for example, the desires of the person using the bed skirt support and the intended placement of the bed on which the bed skirt support will be used. The bed skirt support might also include an optional rear support section 44 (see, e.g., FIG. 9, which is discussed further below). As explained further below, each support section comprises a plurality of layers of material. In FIG. 1, an outer surface 46 of an outer or top layer 48 of the front support section is clearly shown. This top layer has a bottom edge or lower longitudinal edge 50, a top edge or upper longitudinal edge 52 (shown to best advantage in FIGS. 4A and 4B), a left lateral edge 54, and a right lateral edge 56. Similarly, the left side support section 16 comprises a rear lateral edge 58, a front lateral edge 60, a lower longitudinal edge 62, and an upper longitudinal edge 64. The right side support section is similar to, but a mirror image of, the left side support section.

The bed skirt support according to the first embodiment of the present invention is configured for use on a conventional bed 66 (see FIGS. 18 and 19) or a four poster bed (not shown). In particular, the left lateral edge 54 of the front support section 18 is attached to the outer one-half 42 of the zipper at a first terminus 68, and the front lateral edge 60 of, for example, the left side support section 16 is connected to the outer one-half 42 of the zipper at a second terminus 70. As clearly shown in FIGS. 1 and 2, for example, the first terminus 68 is offset from the second terminus 70 so that the bed skirt support may be used in connection with a four poster bed.

Figure 2:
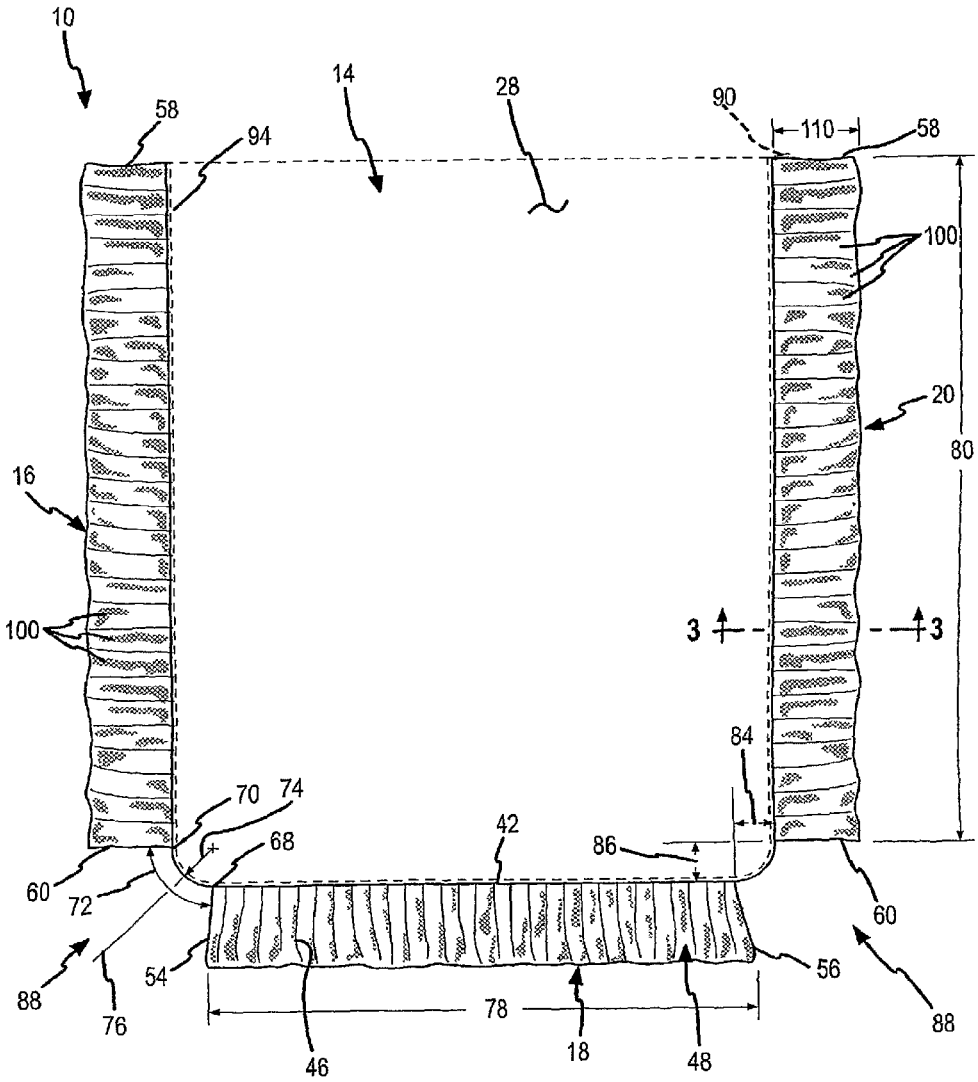
FIG. 2 is a top plan view of the bed skirt support depicted in FIG. 1.

As shown to best advantage in FIG. 2, which is a top plan view of the bed skirt support 10 depicted in FIG. 1, the first terminus or connection point 68 is separated from the second terminus or connection point 70. The distance between the first terminus and the second terminus along the portion of the outer one-half 42 of the zipper is indicated by an edge separation distance line 72. If this edge separation distance is approximately six inches, the bed skirt support 10 can both accommodate the corner posts of a four poster bed and still support a decorative dust ruffle or decorative bed skirt 12 in a lofted configuration while remaining substantially invisible, i.e. with no portions of same readily in view when placed under a consumer's bedskirt. Such an arrangement is significantly distinct from and improved over the nominal corner slits seen in some outer bed skirts, the latter being included to merely accommodate/surround some beds having upraised corner bedposts.

FIG. 2, which is a top view of the bed skirt support 10 depicted in FIG. 1, includes a variety of dimensional information. The decking 14, for example, may have rounded corners as shown in FIG. 2. These rounded corners may be designed to match the shape of the rounded corners of a typical box spring or bottom mattress. In one embodiment, each corner of the decking has a radius of curvature 74 of between 2 or 2.5 inches to 3 or 3.5 inches, more preferably to approximately 2.75 inches, but the radius of curvature 74 of these corners could have a different value; or the corners could be square. As mentioned above, in one particular configuration of the bed skirt support 10 according to the present invention, the distance along the outer perimeter 22 of the decking 14 between the first terminus 68 and the second terminus 70 is approximately six inches (represented by three inches on each side of the center of the preferred 2.75 inches radius). Further, in this particular configuration, this six inch distance is equally split by a line 76 bisecting the curved corner of the decking In this first embodiment of a bed skirt support according to the present invention, the front support section 18 has a width 78 between its left lateral edge 54 and its right lateral edge 56 that varies depending upon the size of the bed on which the bed skirt support is going to be used. For example, for a twin bed, this dimension may be 39.0 inches, for a double size bed this dimension may be 54.0 inches, for a queen size bed, this dimension may be 60.0 inches, for a king size bed this dimension may be 78.0 inches, and for a California king size bed, this dimension may be 72.0 inches. Similarly, the left side support 16 section and the right side support 20 section each has a longitudinal length 80 between its front lateral edge 60 and its rear later edge 58 that varies depending upon the size of the bed on which the bed skirt support is being used. For a twin size bed, this length may be 75 inches; for a double size bed, this dimension may be 75 inches; for a queen size bed, this dimension may be 80.0 inches; for a king size bed, this dimension may be 80.0 inches; and for a California king size bed, this dimension may be 84.0 inches.

Figure 3:
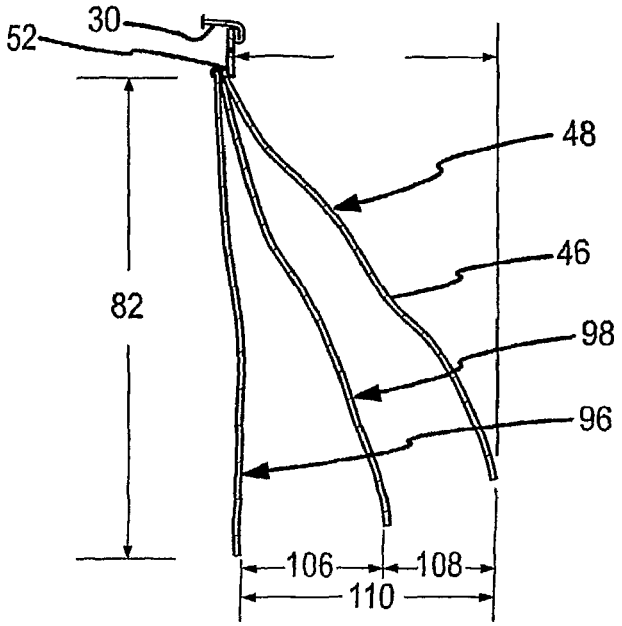
FIG. 3 is a schematic, cross-sectional view taken along line 3-3 of FIG. 2, clearly showing the three-layered configuration of a support section according to the first embodiment of the present invention.

As shown to best advantage in, for example, FIG. 3, which is a schematic, cross-sectional view taken along line 3-3 of FIG. 2, the width 82 of each layer of material comprising each support section according to the first embodiment of the present invention is approximately 13.5 inches. In the embodiment depicted in FIGS. 1 and 2, the corner configuration of the bed skirt support 10 has been defined by the edge separation distance 72 along the corner edge of the decking 14 and the radius of curvature 76 of the corner edge of the decking Alternatively, a front-support edge setback 84 and a side-support edge setback 86 may be used to define the gap 88 between the lateral edges of the front support section 56, 60, respectively, and each side support section that accommodates a corner post of, for example, a four poster bed. A zipper pull 90 is also visible in the upper right hand portion of FIG. 2. As explained further below, and as alluded to above, the right side support section 20, the front support section 18, and the left side support section 16 are all detachable from the decking 14 via the U-shaped zipper 92 mentioned above and explained further below. Also clearly visible in FIG. 2 is the stitching 94 that may be used to attach the inner one-half 40 of the zipper to the decking 14.

Referring next to FIGS. 3, 4A, 4B, and 7, the three-layer configuration of the first embodiment of a bed skirt support according to the present invention is described next. FIG. 3 is a cross sectional view taken along line 3-3 of FIG. 2, looking from the foot of the bed toward the head of the bed. As shown to good advantage in FIG. 3, this embodiment of the present invention comprises three layers of material including a bottom layer 96, an intermediate layer 98, and the top layer 48. In this particular embodiment, the layers are each made from what is commonly referred to as "petticoat netting" or "can can netting," which is a mid-grade or mid-weight netting. This type of netting has been found to provide desirable volume control and puffiness or loft to achieve a desired finished look. A variety of materials could, however, be used for these layers including, for example, bridal veil netting or crinoline.

Figure 4A:
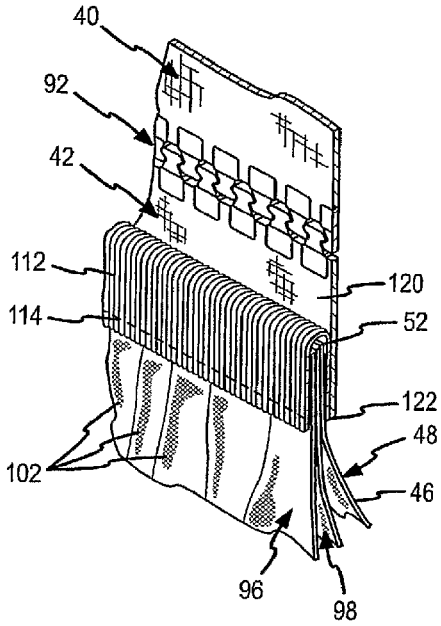
FIG. 4A is an enlarged, fragmentary, schematic view showing a first option for connecting the layers comprising a support section of a bed skirt support according to the present invention to one-half of a zipper.
Figure 4B:
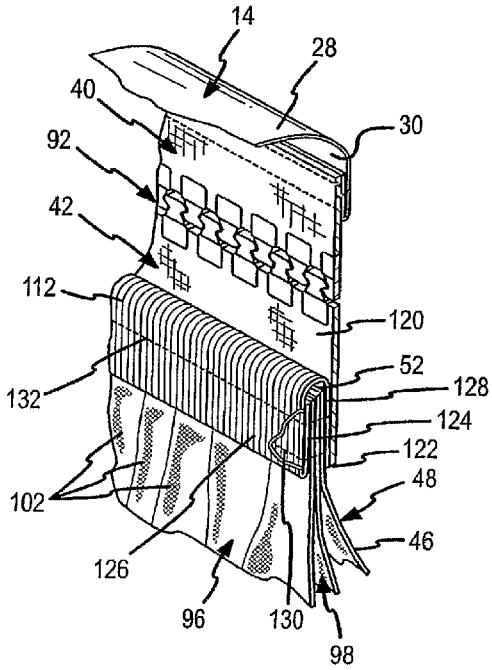
FIG. 4B is an enlarged, fragmentary, schematic view, with a portion of material broken away, showing a second option for connecting the layers comprising a support section of a bed skirt support according to the present invention to one-half of a zipper.
Figure 5:
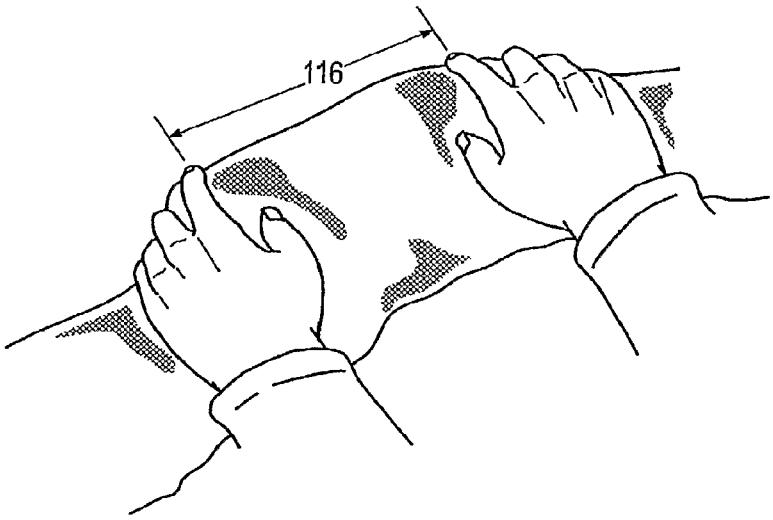
FIGS. 5 and 6 schematically depict a possible manual technique for gathering the material comprising the layers of each support section before attaching that material to the decking
Figure 6:
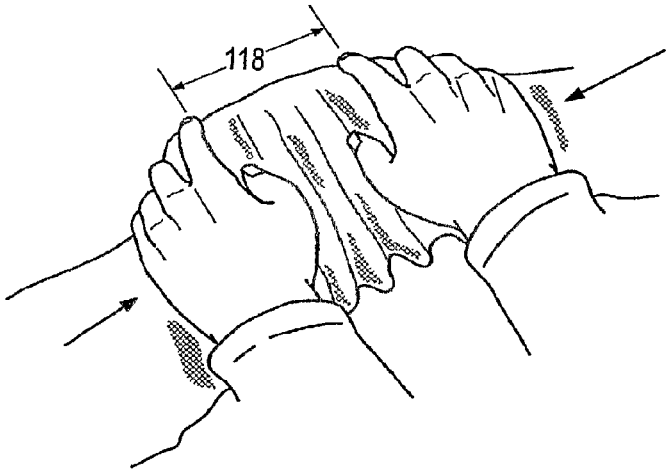

As shown schematically in FIGS. 5 and 6, this netting material may be gathered and then attached to the outer perimeter of the decking FIGS. 5 and 6 are explained further below. The gathers 100 comprising the top layer of material are clearly visible in FIGS. 1, 2, and 7, for example. The bottom layer gathers 102 are clearly visible in, for example, FIGS. 4A, 4B, and 7; and the gathers 104 of the intermediate layer are visible in, for example, FIG. 7. Each layer comprising each support section need not include gathers. In other words, one or more layers comprising each support section of the bed skirt support may comprise relatively flat, ungathered material.

As shown schematically in FIG. 3, the gathered layers of material 48, 96, 98 (e.g., petticoat netting) tend to stand off, or loft away from, each other as result of the gathers. For example, an inner loft 106 may be present between the bottom layer 96 and the intermediate layer 98, and an outer loft 108 may be present between the intermediate layer 98 and the top layer 48. This inner loft 106 and outer loft 108 together comprise the total loft 110 of each support section. As explained further below, the present invention makes it possible to adjust the inner loft, outer loft, and thus the total loft. As shown in FIGS. 3, 4A, and 4B, the upper longitudinal edge 52 of the top layer 48 is connected to the upper longitudinal edges of the intermediate layer 98 and the bottom layer 96. As explained further below, FIGS. 4A and 4B are enlarged, fragmentary, schematic views showing, respectively, a first option for connecting the layers 48, 96, 98 of a bed skirt support 10 to one-half of a zipper 92, and a second option for connecting the layers of a bed skirt support to one-half of a zipper.

As shown in FIG. 4A, the top layer 48, the intermediate layer 98, and the bottom layer 96 of a support section 16, 18, 20 are connected to the outer one-half 42 of the zipper 92 using a strip of grosgrain 112 that has been folded into a U-shaped configuration. Alternatively, any type of binding tape could be used to attach these three layers to the outer one-half of the zipper; or the three layers 48, 96, 98 could be attached directly to the outer one-half 42 of the zipper 92 without the use of any grosgrain or binding tape. In this particular embodiment, the upper longitudinal edges of the layers have been laid one on top of the other. These three stacked layers of material have subsequently been gathered (see, e.g., the manual or hand-gathering technique depicted in FIGS. 5 and 6) and then attached to one another via stitching 114 through the section of grosgrain 112. Alternatively, the grosgrain may be placed on top of the stacked layers of petticoat netting, and that stack may be fed through, for example, a sewing machine having a differential feeding apparatus, which is capable of creating the gathers and attaching the grosgrain to the layers in a single pass.

In the particular embodiment 10 depicted in FIG. 4A, the layers of material 48, 96, 98 are gathered rather than hard folded or pleated, but pleating or folding could also be used. The "gather ratio" used depends on the desired loftiness, the desired adjustability of that loftiness, and the type of material being used for the layers. If, for example, adjustable volume or loftiness is desired and a mid-grade netting (e.g., a petticoat netting) is used, a gather ratio of 4.5:1 may be desirable. In other words, if a length 116 (FIG. 5) of netting before gathering is 4.5 inches, the length 118 (FIG. 6) of the gathered netting would be one inch. This gather ratio may vary fairly broadly from this particularly preferred 4.5:1 ratio. For example, a gather ratio of 6 or 7:1 works for some applications, but may have a few drawbacks. For example, if a gather ratio of 7:1 is used with petticoat netting, the support sections may be more lofty than desirable and the amount of excess material required to manufacture the support sections may undesirably drive up the cost of the overall bed skirt support. Alternatively, a gathering ratio of about 3 or 3.5 inches:1 inch may be used but may result in less lofting ability, however, may be aesthetically desired under one's existing bed skirt.

The volume or loft 110 of the support sections 16, 18, 20 may be adjusted before or after the bed skirt support is manufactured. As just discussed, the gather ratio may be adjusted before or during the manufacturing process to change the "default loft" of the final product. After the bed skirt support is fully constructed, the volume or loft of the support sections may be adjusted by, for example, separating the material between the gathers by hand to spread and smooth the netting, thereby reducing the overall volume or loft 110 of each support section. It may also be possible to reduce the volume or loft of the finished bed skirt support by pulling on the bottom edges 50, 62 of the layers to smooth and flatten the netting around the entire perimeter of the decking On a preferred basis, three pieces of netting material are laid flat and stitched flat at the top. They are then gathered into a preferred ratio of 4.5:1 inches and then stitched as being gathered onto the grosgrain. This preferred construction of the gathering allows for functionality and ability to "nest" so as to be lofted independently of each other and/or do not have to be equally lofted up and/or down. It will also accommodate/adapt to different styles of a consumer's own "outer" bed skirt, (i.e. ruffled, pleated, tailored, etc.) under which the invention is installed. The layers are intertwined to be in conformity with each other in as much as this construction will enable the layers to hold onto their own at whatever level of loft the consumer desires for either or both layers and at the same time be fully adjustable by the consumer's hand by pulling up and out the layers to achieve the desired higher level of loft and/or pulling down and/or relaxing the layers for a lower level of loft depending on whatever style the consumer wants to achieve and/or to better "hold" the weight/type of the material of the consumer's existing outer bed skirt to accomplish its intended purpose of keeping that outer bed skirt off the bedroom floor and/or other aesthetic value.

On a less preferred basis, the layers could be gathered and stitched independent of each other before joining all three layers to the grosgrain. In order to construct this non-preferred, additional labor would be required in sewing the layers three separate times, resulting in additional bulk, less aesthetic value and less functionality and cohesiveness of the layers' ability to nest and be intertwined.

The grosgrain/netting is then sewn onto one side of the zipper tape. The opposite side of the zipper tape is then sewn onto the horizontal decking so that the zipper and/part of the decking falls below and vertically hugs the three-sided perimeter including both fully separated corners.

Referring again to FIG. 4A, a line of straight stitching 114 is shown holding the grosgrain and netting to the underside 120 of the outer one-half of the zipper, adjacent to the lower edge (as shown in FIG. 4A) 122 of the outer one-half 42 of the zipper 92. Although the grosgrain and layers are depicted in FIG. 4A as being attached to the underside 120 of the outer one-half of the zipper, the layers of material may, alternatively, be attached to the top side of the outer one-half of the zipper.

Referring next to FIG. 4B, an alternative technique or construction for connecting the layers of a bed skirt support to one-half of a zipper are described next. In this configuration, the top layer 48, the intermediate layer 98, and the bottom layer 96 of a support section are connected to the outer one-half 42 of the zipper 92 using a strip of grosgrain (or other material) folded into a serpentine or sigmoid configuration including a trapped layer 124 attached to an underside of the bottom layer 96 of the support section, a lowest layer 126 attached to an underside of the trapped layer 124, and an upper layer 126 sandwiched between the outer surface of the top layer of the support section and the underside of the outer one-half of the zipper. An inner stitch 130 and an outer stitch 132 are visible in FIG. 4B. In particular, since a portion of the lowest layer 126 of the serpentine strip of grosgrain is broken away in FIG. 4B, the inner stitch 130 through the trapped layer of grosgrain and through all three layers of the support section is clearly visible. The outer stitch 132, on the other hand, attaches all of the following to the underside 120 of the outer one-half 42 of the zipper 92: the lowest layer 126 of grosgrain 124, the trapped layer of grosgrain, the bottom layer of netting 96, the intermediate layer of netting 98, the top layer of netting 48, and upper layer 128 of grosgrain. Although alternative techniques and configuration could be used (e.g., techniques involving surging the upper longitudinal edges of the netting layers) to attach the three layers of netting to the outer one-half of the zipper, the described configurations have been found to provide desired stability to the finished product.

Figure 4C:
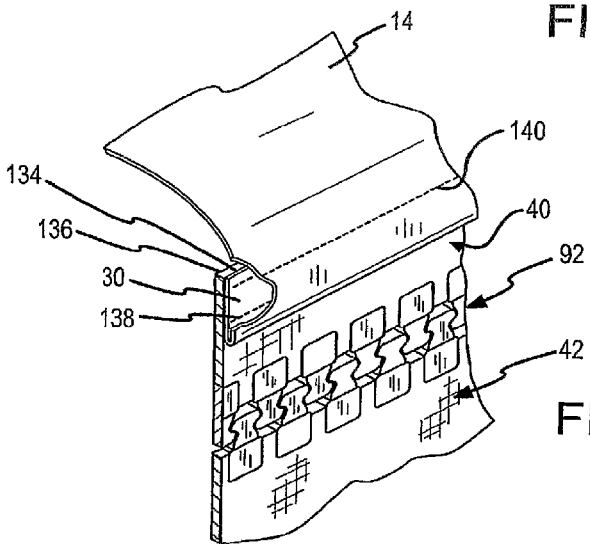
FIG. 4C is an enlarged, fragmentary, schematic view showing one possible way of connecting the decking of a bed skirt support according to the present invention to one-half of a zipper.

FIG. 4C is an enlarged, fragmentary, schematic view showing one possible way of connecting the decking 14 of the bed skirt support according to the present invention to the inner one-half 40 of a zipper. As clearly shown in this figure, a longitudinal edge 134 of the decking may be aligned with a longitudinal edge 136 of the inner one-half of the zipper. A first line 138 of stitching may be applied to hold the decking and the inner one-half of the zipper in place. Subsequently, the decking material may be folded back onto itself, and a second line 140 of stitching may then be applied to securely attach the decking to the inner one-half of the zipper. Again, this is merely one representative configuration for attaching securing the decking to the inner one-half of the zipper.

Figure 7:
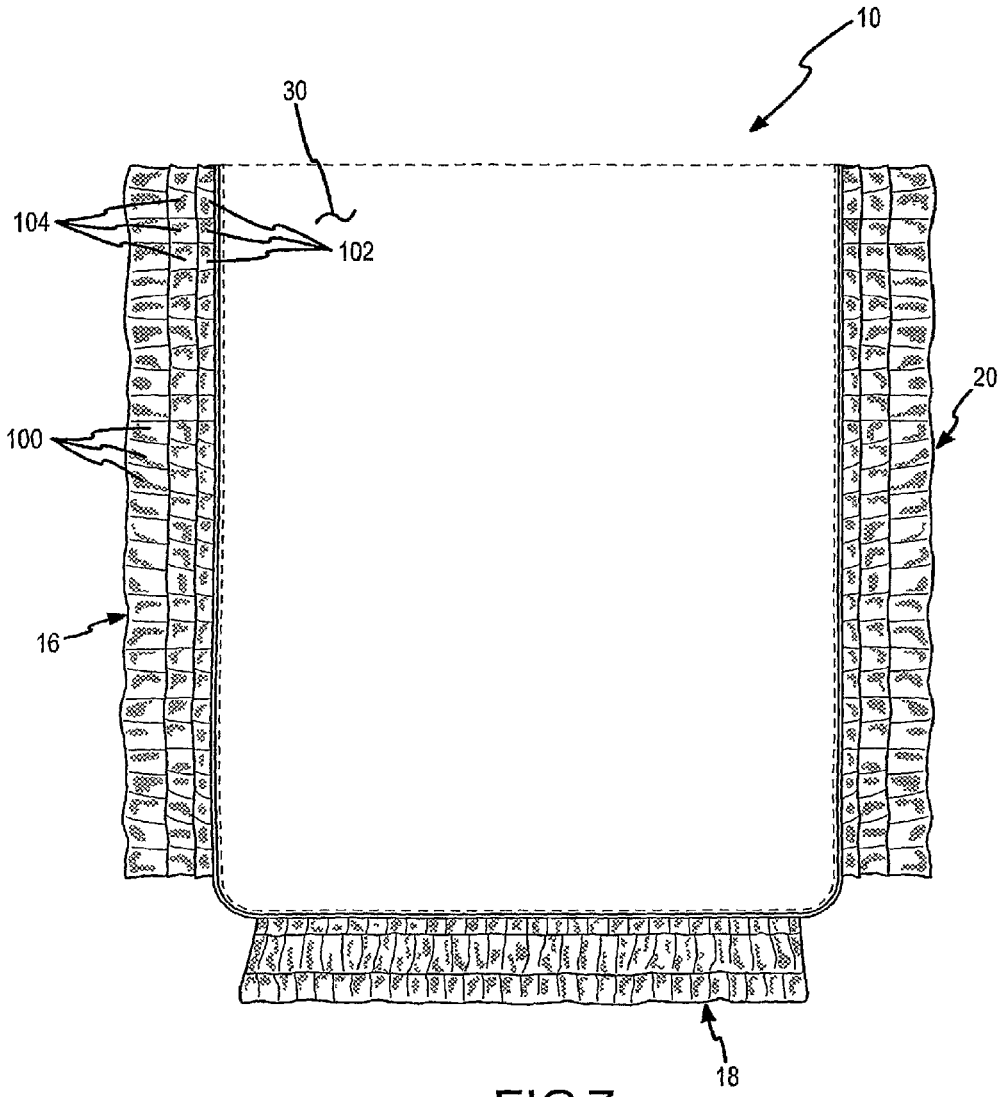
FIG. 7 is a bottom plan view of the bed skirt support depicted in FIG. 1, showing the three layers comprising each support section in this particular configuration.

FIG. 7 is a bottom plan view of the bed skirt support depicted in FIG. 1, showing the three layers comprising each support section in this particular configuration. Although more or fewer layers could be used for each support section, the three-layered configuration depicted in, for example, FIGS. 3, 4, and 7 has proven advantageous. This three-layered configuration has been found to provide adequate support to the decorative bed skirt or dust ruffle that will be placed on top of the top layer of the support sections 16, 18, 20 (see, e.g., FIG. 18) and provides the ability to adjust the loft or puffiness of the bed skirt support.

Figure 8:
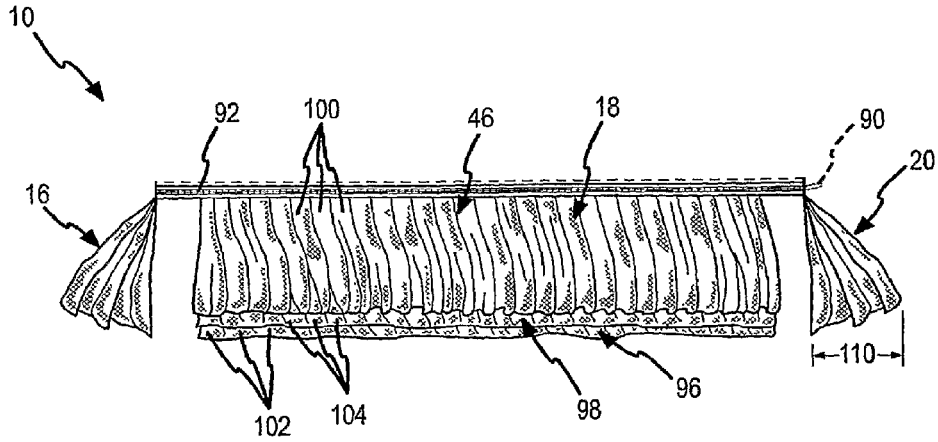
FIG. 8 is an elevation looking directly toward the front support section of the bed skirt support depicted in FIG. 1, which would be at the foot-of-the-bed end of a box spring when the bed skirt support is installed on a bed.

FIG. 8 is an elevation of the bed skirt support according to the first embodiment of the present invention, looking essentially straight at the front support section 18 which, upon installation of the bed skirt support on a bed, would be at the foot of the bed. The top layer 46, the intermediate layer 98, and the bottom layer 96 of the front support section 18 are clearly visible in FIG. 8. The total loft 110 of the right side support section 20 is also clearly visible in FIG. 8. The zipper pull 90, which in this embodiment would be near the head-of-the-bed end of the decking when the left side support section, the front support section, and the right side support section are all fully in place around the perimeter of the decking, is also clearly visible in FIG. 8.

Figure 9:
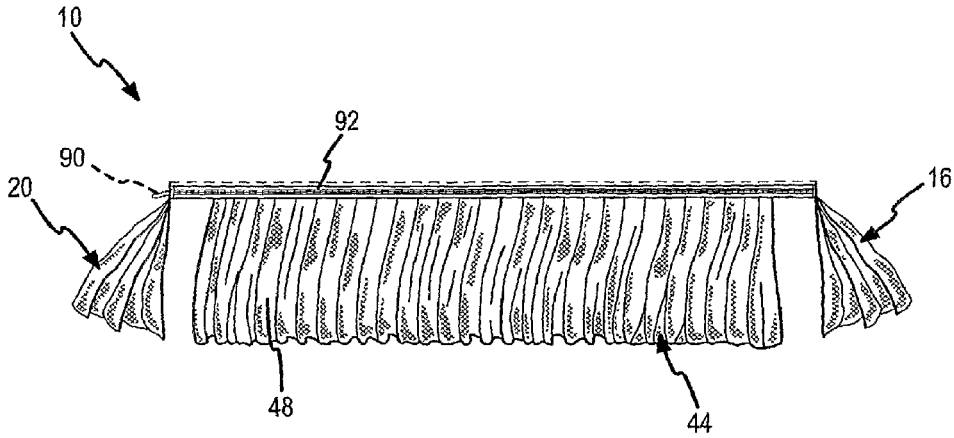
FIG. 9 is an elevation looking toward the optional rear support section of a bed skirt support, which would be at the head-of-the-bed end of a box spring when the bed skirt support is installed on a bed.

FIG. 9 is an elevation looking toward the optional rear support section 44 of a bed skirt support, which would be at the head-of-the-bed end of a box spring when the bed skirt support is installed on a bed. If a bed were positioned, for example, such that it is important to be able to hide the head-of-the-bed side of the box spring, this optional rear support section may also be included and zipped to the head-of-the-bed end of the decking As depicted in FIG. 9, this rear support section has little to no loft, which is evident since only the top layer 48 of the rear support section is visible in FIG. 9. In fact, the rear support section in this particular configuration may only include a decorative top layer. If the head of the bed were to be placed near a wall, this rear support section may be completely removed or eliminated since it would not be required. The total loft 110 of the left and right support sections is clearly visible in FIGS. 8 and 9.

Figure 10:
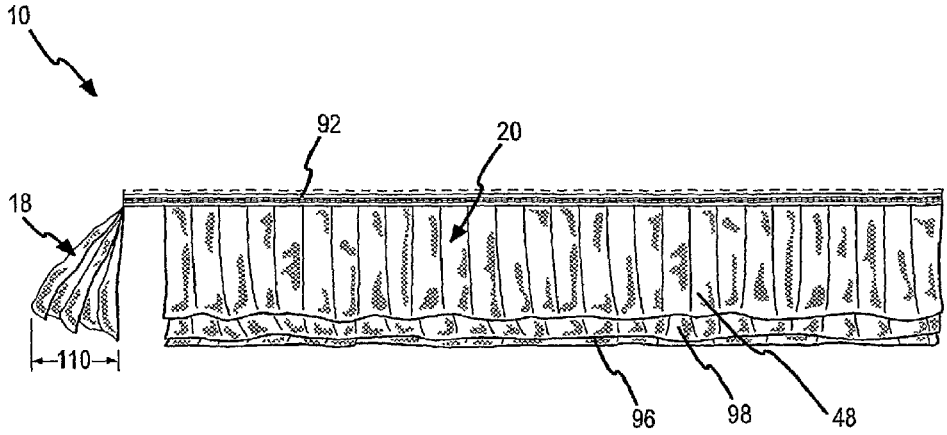
FIG. 10 is an elevation looking directly toward the right side of the bed skirt support depicted in FIG. 1.
Figure 11:
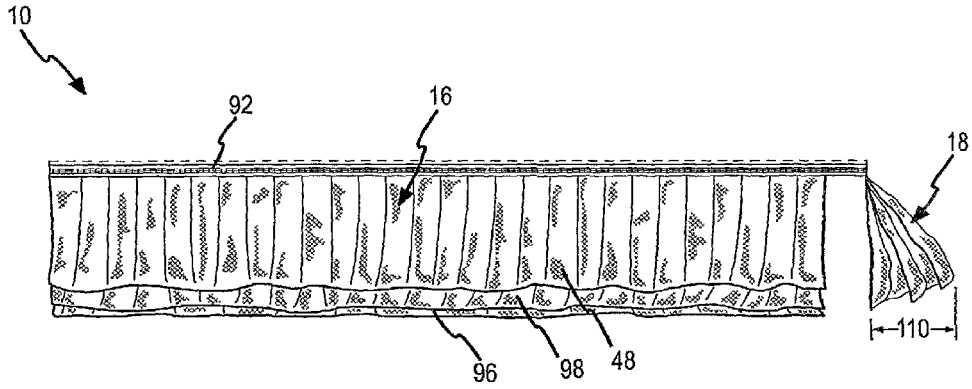
FIG. 11 is an elevation looking directly toward the left side of the bed skirt support depicted in FIG. 1.

FIG. 10 is an elevation looking directly toward the right side of the bed skirt support depicted in FIG. 1. In this particular view, the three layers comprising the right side support section are clearly visible. The total loft 110 of the front support section is also clearly visible in this figure. FIG. 11 is an elevation looking directly toward the left side of the bed skirt support depicted in FIG. 1 and clearly shows the three layers 48, 96, 98 comprising the left side support section 16. FIG. 11 is similar to, but is a mirror image of FIG. 10.

Figure 12:
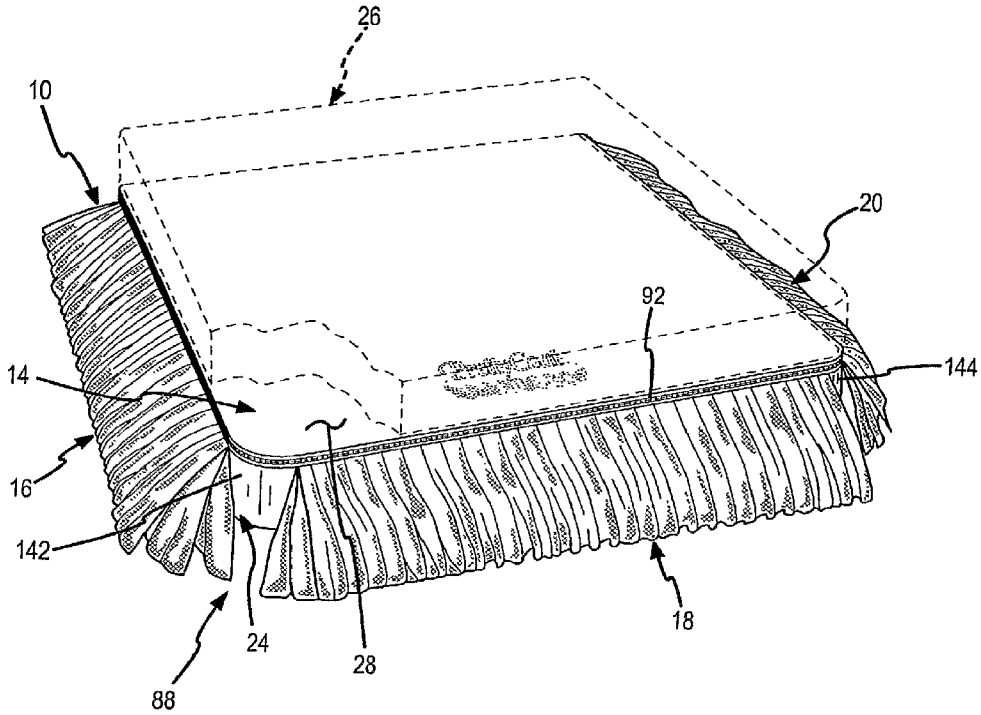
FIG. 12 is a fragmentary, isometric view looking downward toward the left side and front of the bed skirt support depicted in FIG. 1, showing how the bed skirt support might be positioned relative to the top mattress (shown in phantom with a portion broken away for clarity) and the box spring.

FIG. 12 is a fragmentary, isometric view looking downward toward the left side and front of the bed skirt support depicted in FIG. 1, showing how the bed skirt support might be positioned relative to the top mattress 26 and the box spring 24. The top mattress is depicted in FIG. 12 in phantom with a portion broken away to reveal the placement of the decking 14 between the top mattress and the box spring (or bottom mattress). The left front corner 142 and the right front corner 144 of the box spring may be seen in FIG. 12. As it is clearly shown in FIG. 12, the decking 14, which is the flat central portion of the bed skirt support according to present invention, is sandwiched between the bottom surface of the top mattress and the top surface of the box spring when the bed skirt support is installed. The U-shaped zipper 92 connecting the decking to each of the left side support section 16, the front support section 18, and the right side support section 20 is clearly visible in this figure. Advantageously, and as described further above and below, this zipper makes it possible to completely remove the support sections from the decking without the need to disturb the top mattress or the box spring. As mentioned above, the gaps 88 between the side support sections and the front support section make it possible to use the bed skirt support according to the first embodiment on a four poster bed. For example, one of the vertical corner posts of the four poster bed could ride in the gap between the front lateral edge of the left side support section and the left lateral edge of the front support section.

Figure 13:
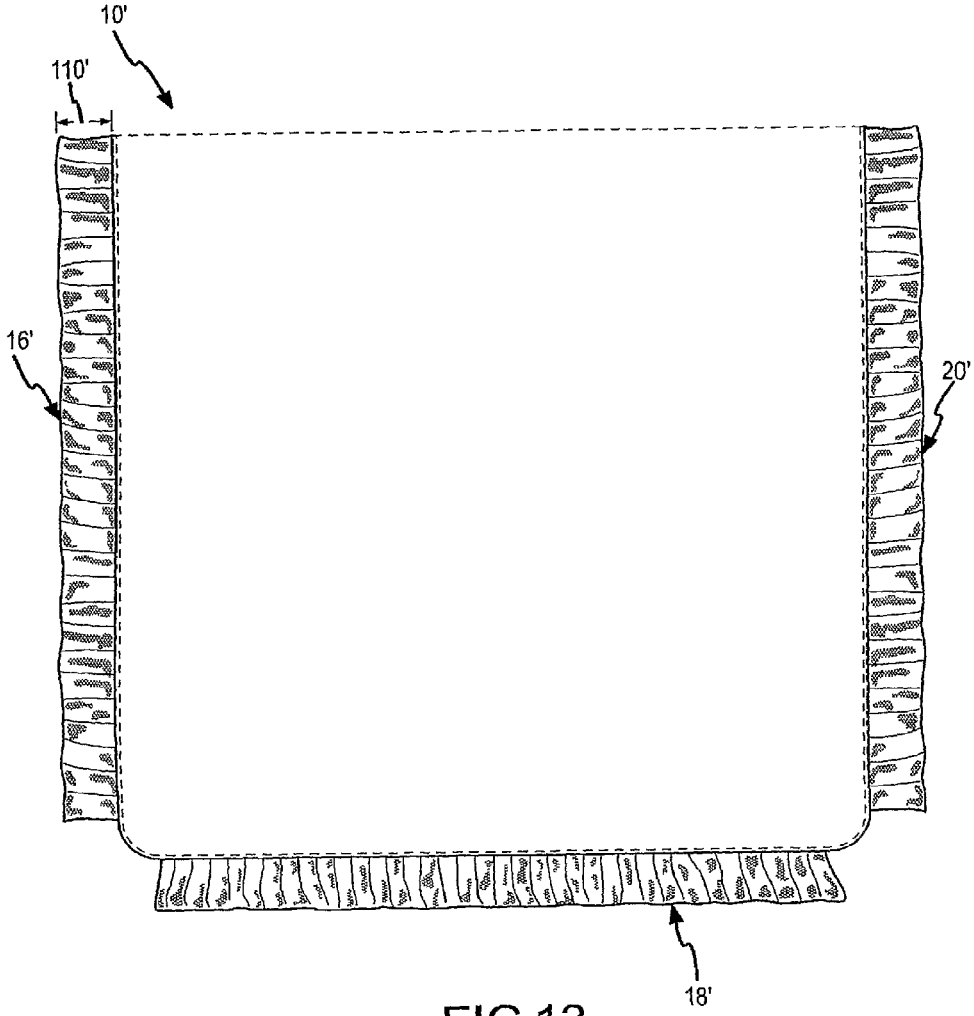
FIG. 13 is similar to FIG. 2, but is a top plan view of a bed skirt support according to a second embodiment of the present invention.

As mentioned above, the loft or puffiness of the left side support section, the front support section, and the right side support section may be adjusted either during manufacturing (e.g., by changing the gather ratio or the type of material being used) or after the bed skirt support 10 is installed on a bed. FIG. 13 is similar to FIG. 2, but is a top plan view of a bed skirt support 10' according to a second embodiment of the present invention. In this embodiment, the total loft 110' of the support sections is less than the total loft of the corresponding sections of the first embodiment. This may be clearly seen by comparing, for example, FIG. 2 to FIG. 13, or FIG. 7 to FIG. 14 (see next paragraph), or FIG. 8 to FIG. 15 (see paragraph after the next paragraph).

Figure 14:
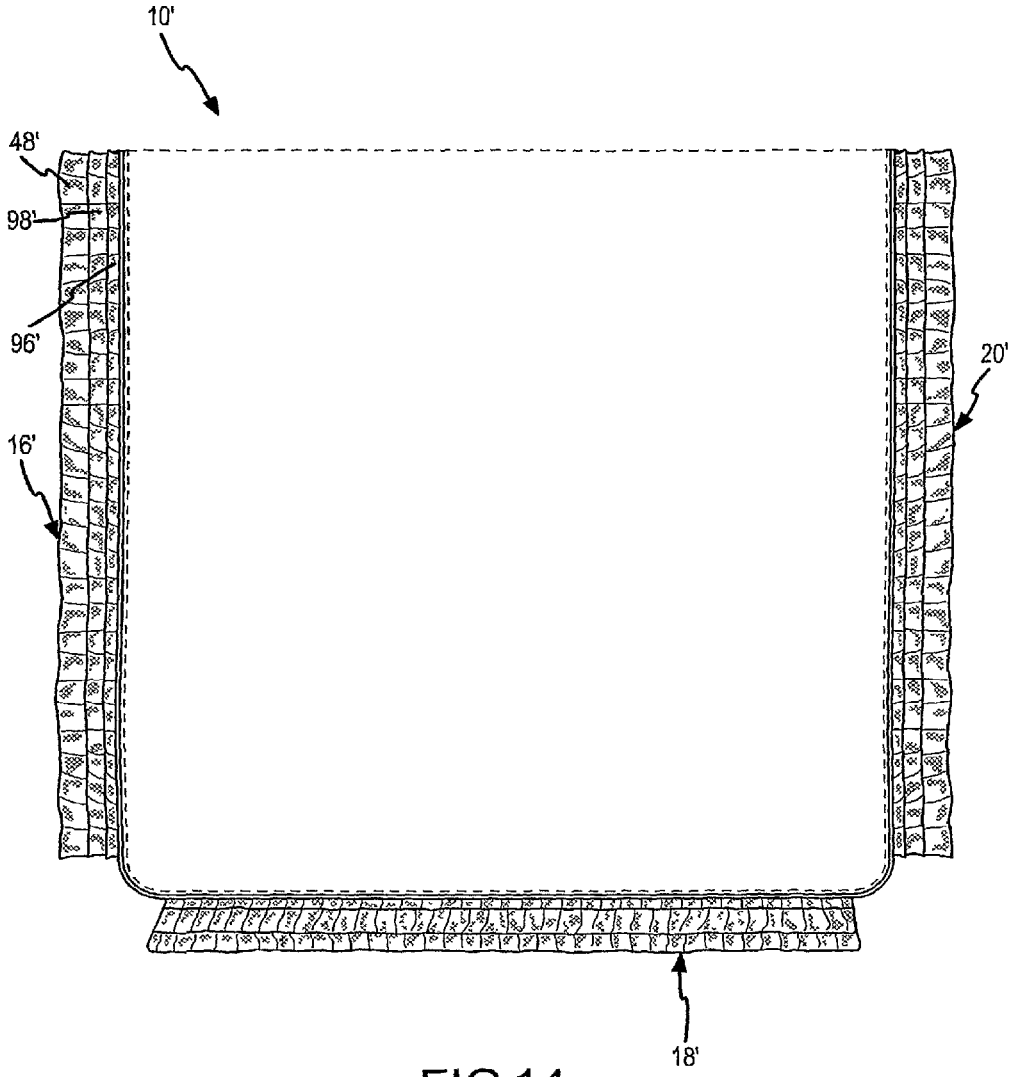
FIG. 14 is similar to FIG. 7, but is a bottom plan view of a bed skirt support according to the second embodiment of the present invention, showing the three-layers comprising each support section in this particular configuration.

FIG. 14 is similar to FIG. 7, but is a bottom plan view of a bed skirt support according to the second embodiment of the present invention, showing the three-layers 48', 96', 98' comprising each support section 16', 18', 20' in this particular configuration. Although a bed skirt support according to the present invention may have more or fewer layers than the three depicted in the figures, the second embodiment again comprises three layers as shown in FIG. 14.

Figure 15:
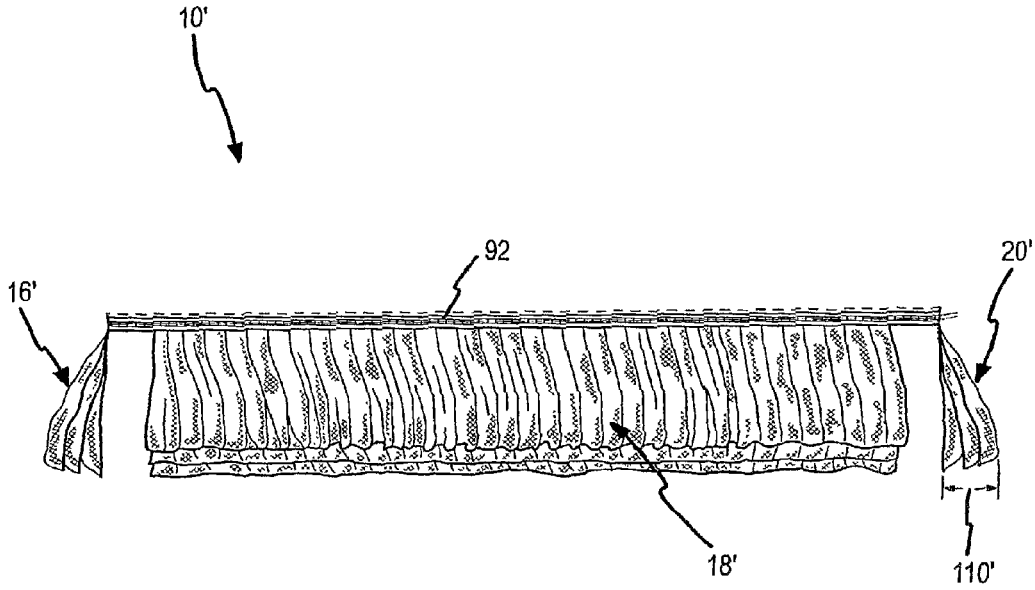
FIG. 15 is similar to FIG. 8, but depicts the bed skirt support according to the second embodiment.

FIG. 15 is similar to FIG. 8, but is an elevation looking directly at the portion of the bed skirt support according to the second embodiment that would be draped over the portion of the top mattress and box spring at the foot of the bed. Again, the three-layered configuration of the second embodiment is clearly visible in FIG. 15, where each of the three layers comprising the front support section is visible. The total loft 110' of the left support section and of the right support section of the bed skirt support according to the second embodiment is also clearly visible in FIG. 15. The total loft of the front support section may be the same as or different from the total loft 110' of the left and right support sections. By comparing the total loft 110 depicted in FIG. 8 to the total loft 110' depicted in FIG. 15, it is clear that the total loft of the embodiment depicted in FIG. 15 is less than or less puffy than the total loft of the embodiment depicted in FIG. 8. Again, the loft may be adjusted during manufacturing by, for example, changing the gather ratio or type of material comprising the layers; or the loft may be adjusted while the bed skirt support is installed on a bed by, for example, separating the material between gathers by hand to spread the netting in the finished product or by pulling on the bottom edge of the layers to smooth and flatten the netting around the entire perimeter of the bed skirt support.

Figure 16:
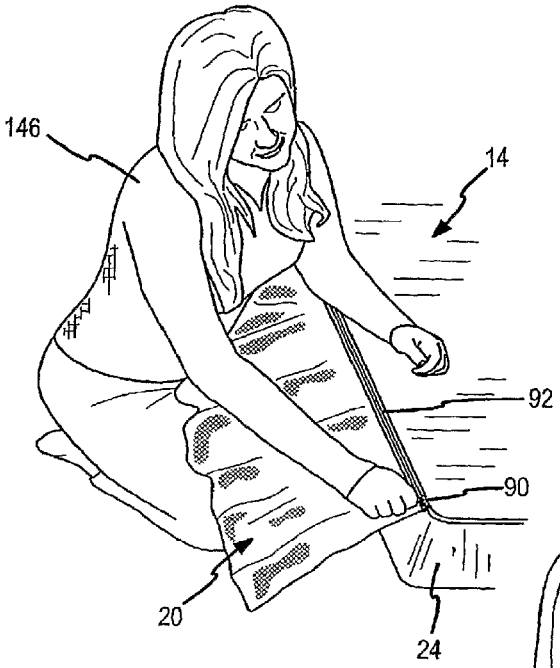
FIGS. 16 and 17 are fragmentary, isometric views of a woman removing the right side support section of a bed skirt support according to the present invention by unzipping it from the decking
Figure 17:
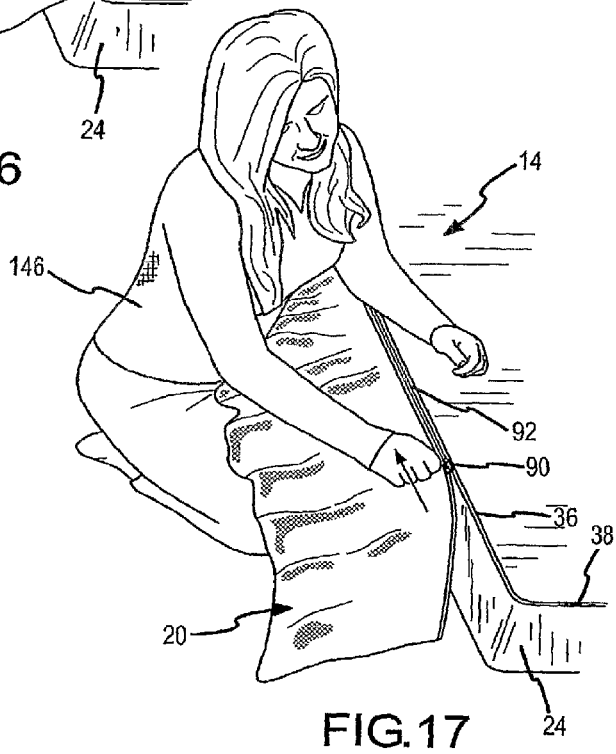
Figure 18:
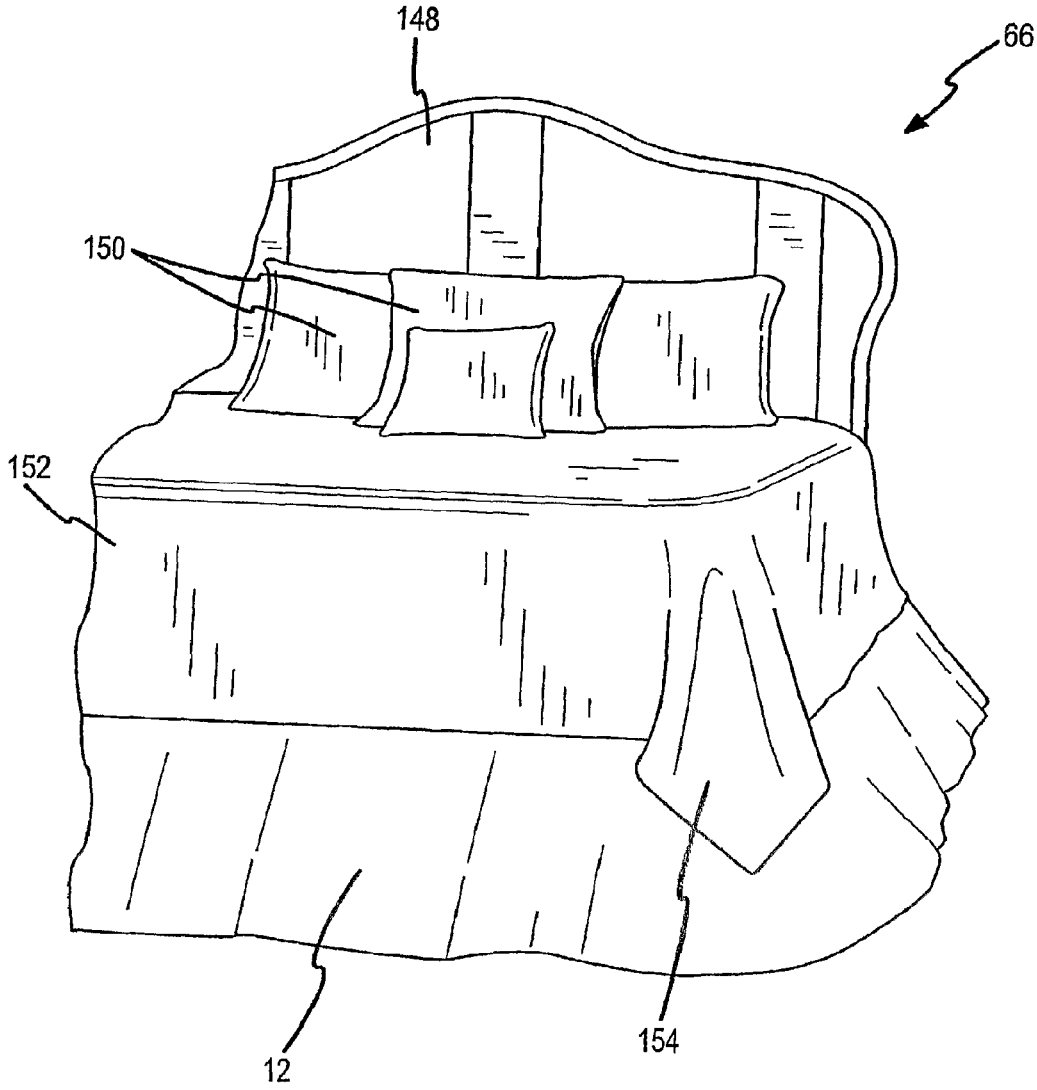
FIG. 18 is a fragmentary, isometric view showing how a decorative bed skirt or a decorative dust ruffle may look when mounted over a bed skirt support according to the present invention.

FIGS. 16 and 17 are fragmentary, isometric views showing how the left side support section 16, the front support section 18, and the right side support 20 section may be removed from the decking In particular, FIGS. 16 and 17 depict a woman 146 removing the right side support section 20 of a bed skirt support 10 according to the present invention by unzipping it from the decking 14. FIG. 16 shows the woman kneeling along the right side of a bed adjacent to the corner of the right side of the bed and the head-of-the-bed. The woman has grabbed the zipper pull 90 and is starting to detach the right side support section from the decking The zipper pull 90 is depicted in the same location in, for example, FIGS. 2 and 8. Although FIGS. 16 and 17 are drawn with the top mattress removed from the top surface of the decking for clarity, the top mattress need not be removed before the support sections are detached from the decking In particular, the top mattress need only be removed if the decking itself needs to be removed from between the bottom side of the top mattress and the top side of the box spring. In FIG. 17, the zipper has been advanced toward the foot of the bed as the right side support section 20 is unzipped from or removed from the right edge 36 of the decking As previously mentioned, although a coil zipper is depicted in the figures, any fastening or connection means could be used to facilitate attachment to, and detachment from, the decking FIG. 18 is a fragmentary, isometric view of a bed 66 showing how a decorative bed skirt or a decorative dust ruffle 12 may look when mounted over a bed skirt support according to the present invention. In particular, FIG. 18 depicts a headboard 148, a number of pillows 150, a decorative bed spread 152, and a decorative bed skirt or dust ruffle 12. The decorative bed skirt depicted in FIG. 18 is being supported by a bed skirt support 10, 10' (not visible in this figure) according to the present invention. As clearly shown in this figure, the loft of the support sections of the bed skirt support are holding the decorative bed skirt at a flowing angle from the lower edge of the bed spread 152 towards the floor of the room, providing a dramatic and aesthetically-pleasing appearance.

The particular bed depicted in FIG. 18 is not a four poster bed. The decorative bed spread includes an ornamental fold 154 in the corner where one of the vertical posts of a four poster bed would otherwise reside. As shown in this figure, the decorative bed skirt or dust ruffle may comprise a substantially continuous piece of fabric that extends around the lower perimeter of the bed, or at least around three sides of that lower perimeter. Noticeably, the gap 88 (see, e.g., FIG. 2) between, for example, the right side support section 16 and the front support section 18 of the bed skirt support does not affect the presentation of the decorative bed skirt. In particular, the bed skirt support may be constructed without the gap (FIG. 2), or the material comprising the three layers of the front section and the material comprising the three layers of the right side support section may be pulled into the gap that would otherwise exist, thereby supporting the decorative bed skirt throughout the corner section. The right lateral edge 56 of the front support section may even be permanently or temporarily attached to the front lateral edge 60 of the right side support section to better support the decorative bed skirt in the corner.

Figure 19:
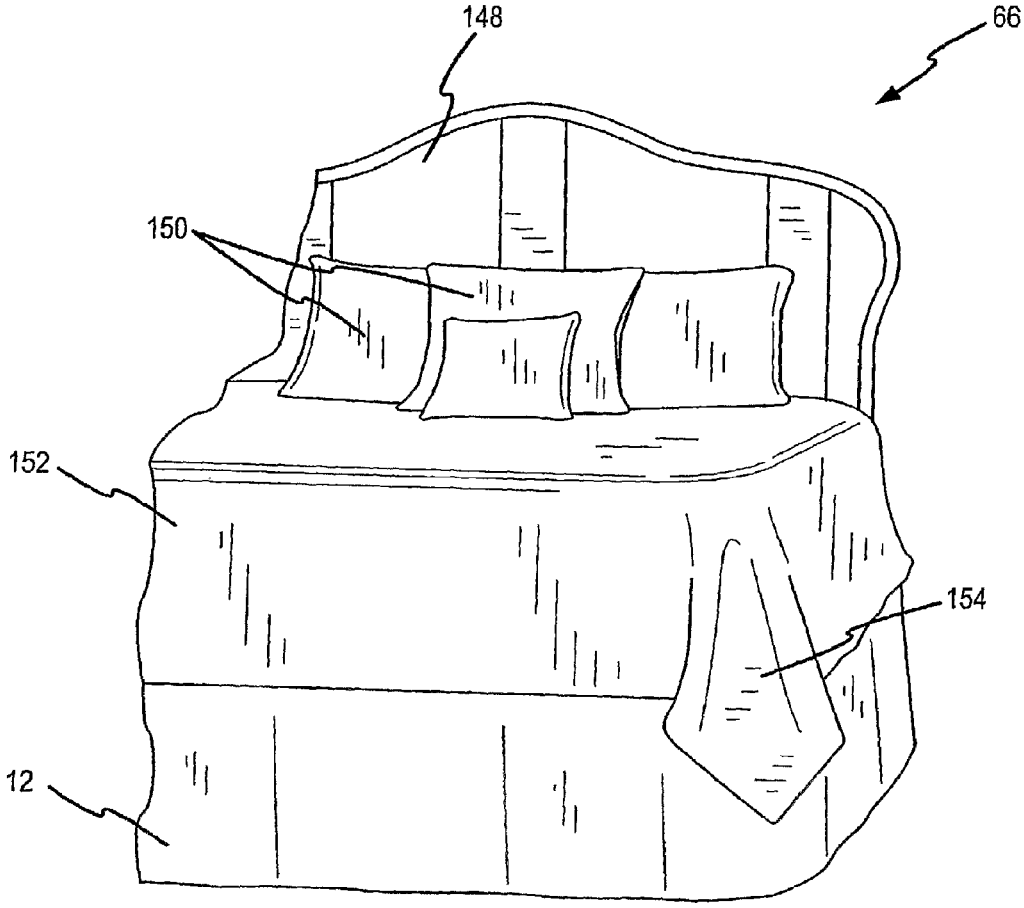
FIG. 19 depicts the decorative bed skirt or decorative dust ruffle shown in FIG. 18 in an unsupported, prior art configuration.

FIG. 19 is similar to FIG. 18, but depicts the decorative bed skirt or decorative dust ruffle shown 12 in FIG. 18 in an unsupported, prior art configuration. In other words, the decorative bed skirt shown in FIG. 19 is not being supported by a bed skirt support according to the present invention. As shown, without the bed skirt support of the present invention, the decorative bed skirt or dust ruffle hangs nearly vertically toward the floor. In this limp, droopy configuration, the decorative bed skirt is not only less attractive, but also is more likely to be damaged by someone inadvertently stepping on the decorative bed skirt or sucking a portion of it into a vacuum.

Although multiple embodiments of this invention have been described above with a certain degree of particularity, those skilled in the art could make numerous alterations to the disclosed embodiments without departing from the spirit or scope of this invention. For example, more than three layers of material or fewer than three layers of material may be used for the support sections. An important feature of this invention is how the support sections support the decorative bed skirt, holding the decorative bed skirt away from the vertical sides of the box spring or lower mattress. All directional references (e.g., upper, lower, inner, outer, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joiner references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A combination of a bed skirt and an under bed skirt support for positioning beneath and lifting said bed skirt outwardly from a box spring and upwardly off a floor, said combination comprising:

the bed skirt; and the under bed skirt support comprising:

a decking adapted to lie on said box spring, wherein said decking has a perimeter; and at least one under bed skirt support section adapted for attaching to said decking perimeter, said under bed skirt support section including two or more separate layers of lofting material, each layer of lofting material having an upper longitudinal edge, the upper longitudinal edges of all separate layers being commonly connected and gathered, each layer having an ability to have its volume of loft adjusted separately from an adjacent layer before the bed skirt is positioned thereover, wherein said bed skirt is discrete from said under bed skirt support.

2. The bed skirt and under bed skirt combination of claim 1, wherein said separate layers of lofting material are connected before being gathered at different gathering ratios.

3. The bed skirt and under bed skirt combination of claim 1, wherein each under bed skirt support section comprises at least three layers, a first and a second layer having a first volume of loft; and the second layer with a third layer having a second volume of loft.

4. The bed skirt and under bed skirt combination of claim 1, wherein said lofting material comprises petticoat netting.

5. The bed skirt and under bed skirt combination of claim 1, wherein upper longitudinal edges of the separate layers are gathered at a ratio of at least about 3:1.

6. The bed skirt and under bed skirt combination of claim 1, wherein upper longitudinal edges of the separate layers are gathered at a ratio of less than about 7:1.

7. The bed skirt and under bed skirt combination of claim 1, wherein upper longitudinal edges of the separate layers are gathered at a ratio between about 4:1 to 5:1.

8. A combination decorative bed skirt and under bed skirt support for lifting a lower edge of said decorative bed skirt outwardly from a box spring and upwardly off a bedroom floor, said combination comprising:

a decorative bed skirt; and an under bed skirt support which comprises:

a decking comprising a substantially rectangular portion defining a perimeter having a front edge, two side edges, and a rear edge;

a front under support section fixedly attached to said front edge of said decking;

a first side, under support section fixedly attached to said first side edge of said decking; and a second side, under support section fixedly attached to said second side edge of said decking, said front under support section and both side under support sections being fully separated from each other by a gap of at least about five inches, each of said under support sections being comprised of multiple layers of separate sheet material with the separate sheets comprising each support section being commonly joined along their upper longitudinal edges and gathered to lift the lower edge of the decorative bed skirt beneath which said under bed skirt support is positioned, wherein said bed skirt is discrete from said under bed skirt support.

9. The decorative bed skirt and under bed skirt combination of claim 8, wherein said gap extends on both sides of a radius of curvature between about 2 and 3.5 inches.

10. The decorative bed skirt and under bed skirt combination of claim 9, wherein said gap extends equally on both sides of the radius of curvature.

11. The decorative bed skirt and under bed skirt combination of claim 9, wherein said radius of curvature is between about 2.5 and 3 inches.

12. The decorative bed skirt and under bed skirt combination of claim 11, wherein said radius of curvature is about 2.75 inches.

13. The decorative bed skirt and under bed skirt combination of claim 8, wherein the separate sheets for said front under support section and both side under support sections consist essentially of netting.

14. The decorative bed skirt and under bed skirt combination of claim 8, wherein the separate sheets for said front under support section and both side under support sections each consist essentially of a petticoat material.

15. The decorative bed skirt and under bed skirt combination of claim 8, wherein said front under support section and both side under support sections are each comprised of three or more layers of gathered material.

16. The decorative bed skirt and under bed skirt combination of claim 8, wherein the gap between said front under support section and the adjacent side under support section is about 6 inches wide.

17. A combination of a bed skirt and an under bed skirt support for positioning beneath said bed skirt to lift its lowermost edges outwardly from a box spring and upwardly off a floor, said combination comprising:

a bed skirt; and an under bed skirt support which comprises:

a decking comprising a substantially rectangular portion defining a perimeter having a first pair of substantially parallel edges and a second pair of substantially parallel edges;

a first side under support section removably attached to one of said first pair of substantially parallel decking edges;

a second side under support section removably attached to one of said second pair of substantially parallel decking edges; and a third side under support section removably attached to the other of said second pair of substantially parallel decking edges, each of said first, second and third side under support sections comprising a separate top layer and separate bottom layer of netting first joined at their upper longitudinal edges before being gathered to provide an adjustable volume of loft beneath said bed skirt, and said under bed skirt support having fully separated corners between adjacent side under support sections, wherein said bed skirt is discrete from said under bed skirt support.

18. The bed skirt and under bed skirt support combination of claim 17, wherein each of said first, second and third side under support sections includes a plurality of layers of netting between their separate top and bottom layers.

19. The bed skirt and under bed skirt support combination of claim 17, wherein adjacent side under support sections are separated by a corner gap at least about 5 inches wide.

20. The bed skirt and under bed skirt support combination of claim 17, wherein at least part of the decking falls below and vertically hugs the three-sided perimeter including both fully separated corners.

* * * * *